US006779690B2

(12) United States Patent
Masuzzo et al.

(10) Patent No.: US 6,779,690 B2
(45) Date of Patent: Aug. 24, 2004

(54) DOUBLE-ACTING PUMP FOR EJECTING A PRODUCT FROM A CONTAINER

(75) Inventors: Ettore Masuzzo, Eppstein (DE); Stefan Christ, Hochheim (DE)

(73) Assignee: AERO Pump GmbH, Hochheim//Main (DE)

( * ) Notice: Subject to any disclaimer, the term of this patent is extended or adjusted under 35 U.S.C. 154(b) by 0 days.

(21) Appl. No.: 10/619,164

(22) Filed: Jul. 11, 2003

(65) Prior Publication Data

US 2004/0007597 A1 Jan. 15, 2004

(30) Foreign Application Priority Data

Jul. 13, 2002 (DE) ..... 102 31 751

(51) Int. Cl.[7] ..... B05E 9/043

(52) U.S. Cl. ..... 222/321.4; 222/321.9; 222/222; 222/380

(58) Field of Search ..... 222/321.4, 321.9, 222/380, 376, 382, 385

(56) References Cited

U.S. PATENT DOCUMENTS

| | | | | |
|---|---|---|---|---|
| 4,065,038 A | * | 12/1977 | Magers et al. | 222/321.9 |
| 4,371,098 A | | 2/1983 | Nozawa et al. | |
| 5,655,689 A | | 8/1997 | Fuchs et al. | |
| 5,692,649 A | | 12/1997 | Schwab | |
| 5,979,712 A | * | 11/1999 | Montaner et al. | 222/321.4 |
| 5,992,704 A | * | 11/1999 | Jager-Waldau | 222/321.9 |
| 6,119,902 A | * | 9/2000 | Shimada et al. | 222/321.9 |

FOREIGN PATENT DOCUMENTS

| | | |
|---|---|---|
| CH | 650992 | 8/1985 |
| DE | 2709796 | 9/1978 |
| DE | 3427793 | 2/1986 |
| DE | 4400944 | 7/1995 |
| WO | 8600830 | 2/1986 |

* cited by examiner

*Primary Examiner*—Philippe Derakshani
(74) *Attorney, Agent, or Firm*—Friedrich Kueffner

(57) ABSTRACT

A double-acting pump for ejecting a product from a container, with a housing in which a piston with an axial bore is axially slideable and sealed by a first housing portion, with a hollow piston rod which extends the axial bore of the piston and is slideable in an opening of a closing cap of the housing and container. When an actuating head is actuated, it presses the piston against the force of a restoring spring toward a connecting pipe portion for an immersion pipe provided in the housing, so that a pressure is built up in a pressure chamber of the housing which presses a first valve closing piece in the connecting pipe piece against a first valve seat. In the non-actuated state, the piston releases as a result of the restoring force of a spring a passage between a pressure chamber and at least one opening in a second housing portion, wherein the connecting pipe piece has a second valve seat and a second valve closing piece which, in a position of the double-acting pump in which an actuating head is lower than the connecting pipe piece, the second valve closing piece assumes its closing position at the second valve seat, and the second valve closing piece assumes its open position in an inverted position in which the actuating head is higher than the connecting pipe piece.

2 Claims, 4 Drawing Sheets

DOUBLE-ACTING PUMP FOR EJECTING A PRODUCT FROM A CONTAINER

BACKGROUND OF THE INVENTION

1. Field of the Invention

The present invention relates to a double-acting or lift and force pump for ejecting a product from a container, with a housing in which a piston with an axial bore is axially slideable and sealed by a first housing portion, with a hollow piston rod which extends the axial bore of the piston and is slideable in an opening of a closing cap of the housing and container, wherein the hollow piston rod has at its free end a tightly fastened actuating head, wherein, when the actuating head is actuated, the actuating head presses the piston against the force of a restoring spring toward a connecting pipe portion for an immersion pipe provided in the housing, so that a pressure is built up in a pressure chamber of the housing which presses a first valve closing piece in the connecting pipe piece against a first valve seat, wherein an outlet duct connected to the bore extends through the actuating head and through a check valve up to an ejection opening for the product, and with at least one opening in a second housing portion between the first housing portion and the closing cap.

2. Description of the Related Art

In a double-acting pump of this type disclosed in DE 27 09 796 B2, the product can be suctioned from the container and can be ejected by a pressure stroke when the pump is in the normal upright position in which the actuating head is located higher than the connecting pipe piece. However, in the inverted position, i.e., the upside down position, the product could not be ejected out of the container as soon as the filling level in the container is in the upside position lower than the suction opening of the immersion pipe, which is also called ejection pipe. The product ejection would be possible in this upside down position only if a suction stroke has been carried out previously in the normal position.

SUMMARY OF THE INVENTION

Therefore, it is the primary object of the present invention to provide a double-acting pump of the above-described type in which the products can be suctioned from the container and dispensed from the container even in an upside down position in which a filling level of the product in the container is lower than the suction opening of the immersion pipe.

In accordance with the present invention, in the non-actuated state, the piston releases as a result of the restoring force of the spring a passage between the pressure chamber and the at least one opening in the second housing portion, wherein the connecting pipe piece has a second valve seat and a second valve closing piece which, in a position of the double-acting pump in which the actuating head is lower than the connecting pipe piece, the second valve closing piece assumes its closing position at the second valve seat, and the second valve closing piece assumes its open position in an inverted position in which the actuating head is higher than the connecting pipe piece.

In this solution according to the present invention, in an upside down position of the pump, the product is suctioned into the pressure chamber during the suction stroke of the pump through the opening or openings in the housing wall and the passage, and the product is ejected during the pressing stroke. Accordingly, the double-acting pump can suction and dispense the product in the upright position of the pump as well as in the upside down position of the pump.

In accordance with a preferred feature, the passage is formed by at least one axial nut in the inner side of a middle housing portion between the first and second housing portions.

Also, the second valve closing piece may be actuatable by its own weight.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
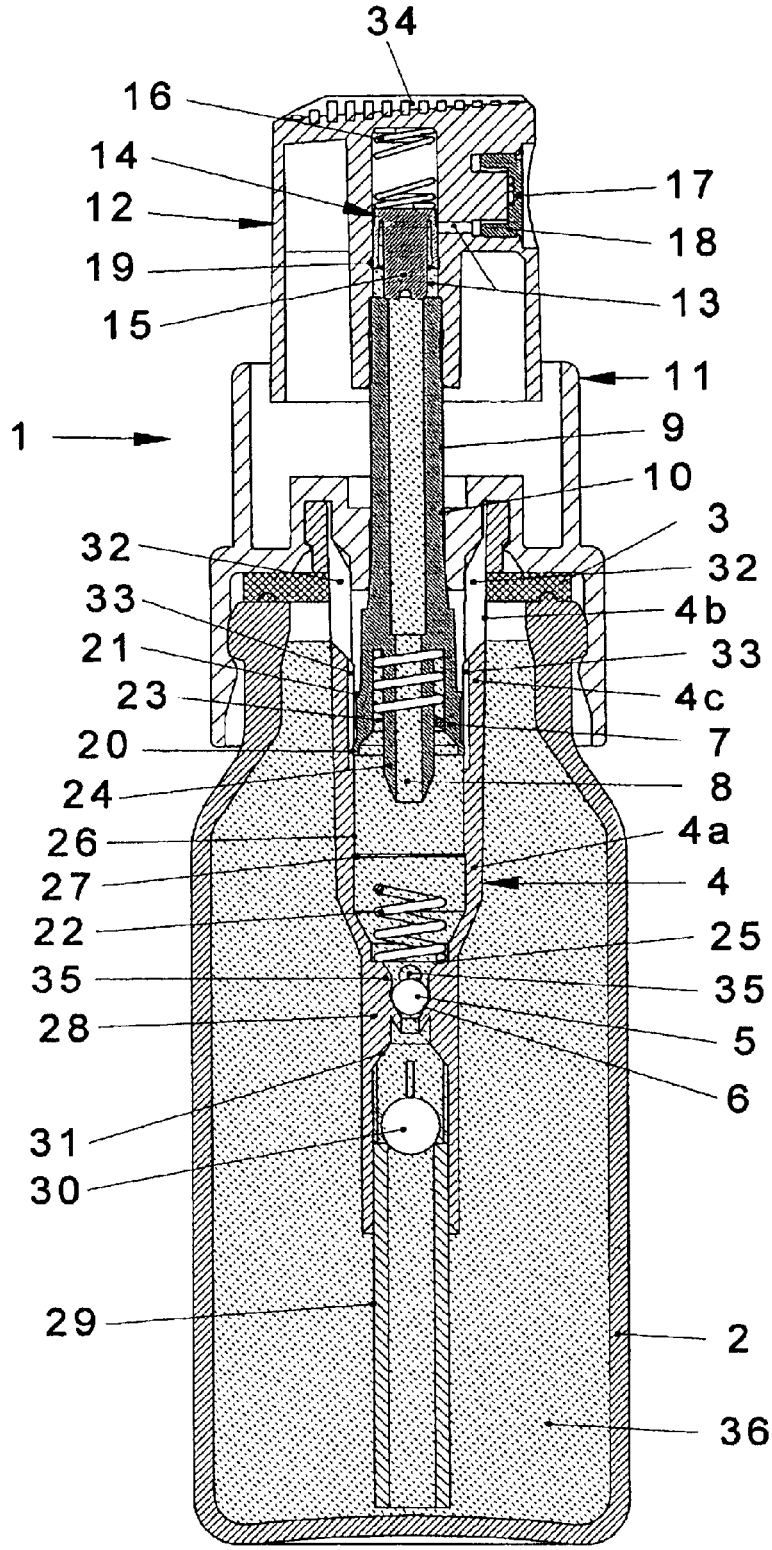
FIG. 1 is an axial sectional view of a double-acting pump and a container according to the present invention, shown before the container is filled with a product to be ejected.

As illustrated in the drawing, a double-acting pump 1 is tightly attached to the rim of the opening of a container 2 via a sealing ring disc 3 arranged between the pump and the container. The double-acting pump 1 includes a hollow-cylindrical housing 4 whose lower end can be closed by a check valve with a first valve closing piece 5 in the form of a ball. In its lower position illustrated in FIG. 1, the valve closing piece 5 is tightly seated on a valve seat 6. A hollow-cylindrical piston 7 is axially displaceable in the housing 4, wherein the piston 7 is sealed relative to the inner side of the housing 4 in a first housing portion 4*a*. The bore of the piston 7 continues in a hollow piston rod 9 which is integrally formed at the piston 7. The piston rod 9 is displaceable in an opening 10 of an upper closing cap 11, wherein the piston rod 9 is sealed relative to the housing 4 and the container 2.

An actuating head 12 of the double-acting pump 1 is tightly and firmly placed on the free end of the piston rod 9 which protrudes out of the housing 4. An outlet duct 1, which is connected to the bore 8, extends through the actuating head 12. The outlet duct 13 extends through a check valve 14 with a valve closing piece 12 and a restoring spring 16 up to an ejection opening 17 in an insert 18 which contains a turbulence chamber opening into the ejection opening 17.

The valve closing piece 15 is composed of a rubber-elastic material, i.e., an elastomer, and includes a cylindrical body which is surrounded approximately in its axial middle by a sealing lip 19. The sealing lip 19 rests with a spring force resulting from its own elasticity against the inner side of a first portion of the outlet duct 13 which extends coaxially with the piston rod 9 and, in the non-actuated state of the actuating head 12 the sealing lip 19 blocks a second portion of the outlet duct 13 which extends transversely of the first portion.

Figure 2:
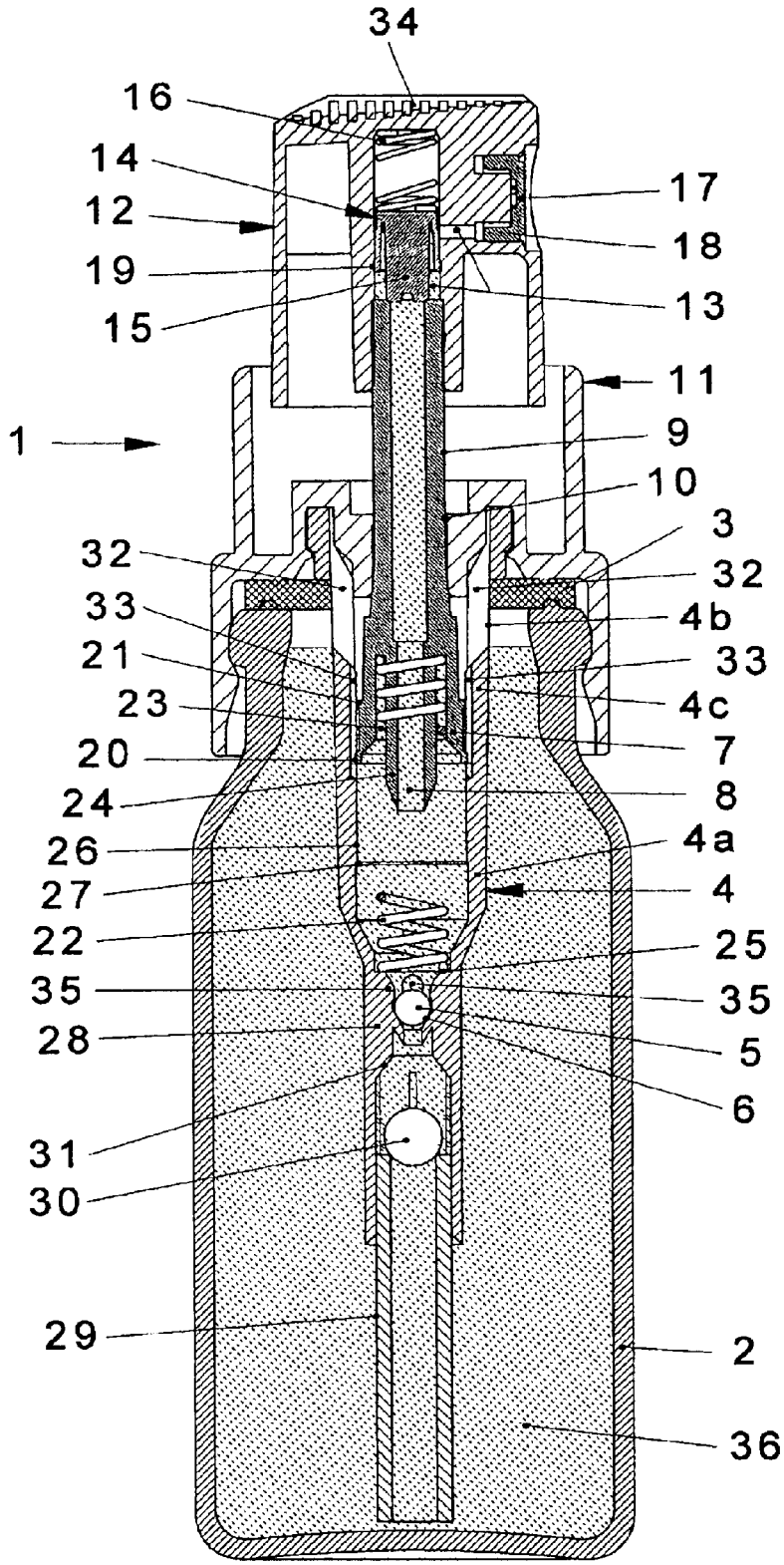
FIG. 2 is the same axial sectional view as FIG. 1, shown with the container and the pump containing the product to be ejected.

In its non-actuated position illustrated in FIGS. 1 and 2, the piston 7 rests with a circumferential sealing lip 20 at its free end tightly against the inner side of the housing 4. A collar 21 surrounding the piston 7 above the sealing lip 20 serves to guide the piston during its movement, however, a play remains between the collar 21 and the inner side of the housing 4. A restoring spring 22, shown in broken lines, rests in the piston 7 against the bottom of an annular chamber 23 which is defined by the outer wall of the piston 7 and a connecting pipe piece 24, on the one hand, and, on the other hand, against a shoulder 25 in the housing 4. As seen in FIG. 1, the housing 4 has at a lower end of a pressure chamber 26 defined by the housing 4 a step 27, wherein the inner diameter of the housing 4 underneath the step 27 is slightly greater than the outer diameter of the sealing lip 20 of the piston. An immersion pipe 29 extending close to the bottom of the container 2 is fastened in a connecting pipe piece 28 at the free lower end of the housing 4. A second valve closing piece 30 in the form of a ball is axially displaceably arranged in the connecting pipe piece 28 between the inner end of the immersion pipe 29 and the valve seat 6, wherein the second valve closing piece 30 interacts with a second valve seat 31 in the connecting pipe piece 28 and is actuatable by its own weight, as is the case in the first valve closing piece 5. The check valve formed by the first valve closing piece 5 and the first valve seat 6 closes and opens oppositely to the check valve formed by the second valve closing piece 30 and the second valve seat 31.

Above the upper end position of the piston 7 illustrated in FIGS. 1 and 2, four slot-shaped openings 32 which are uniformly distributed over the housing circumference are formed in a second portion 4*b* of the housing 4 which borders the closing cap 11. The openings 32 connect the inner space of the housing 4 with the inner space of the container 2 above the maximum filling level of the product contained in the container 2 in the upright position as shown in FIG. 2. However, basically one opening 2 would be sufficient. In the non-actuated state, the piston 7 releases as a result of the force of the restoring spring 22 a passage 33 in the form of axial grooves in the inner side of a middle housing portion 4*c* between the first housing portion 4*a* and the second housing portion 4*b*. Also in this case, only one groove 33 in the middle housing portion 4*c* would be sufficient.

Figure 3:
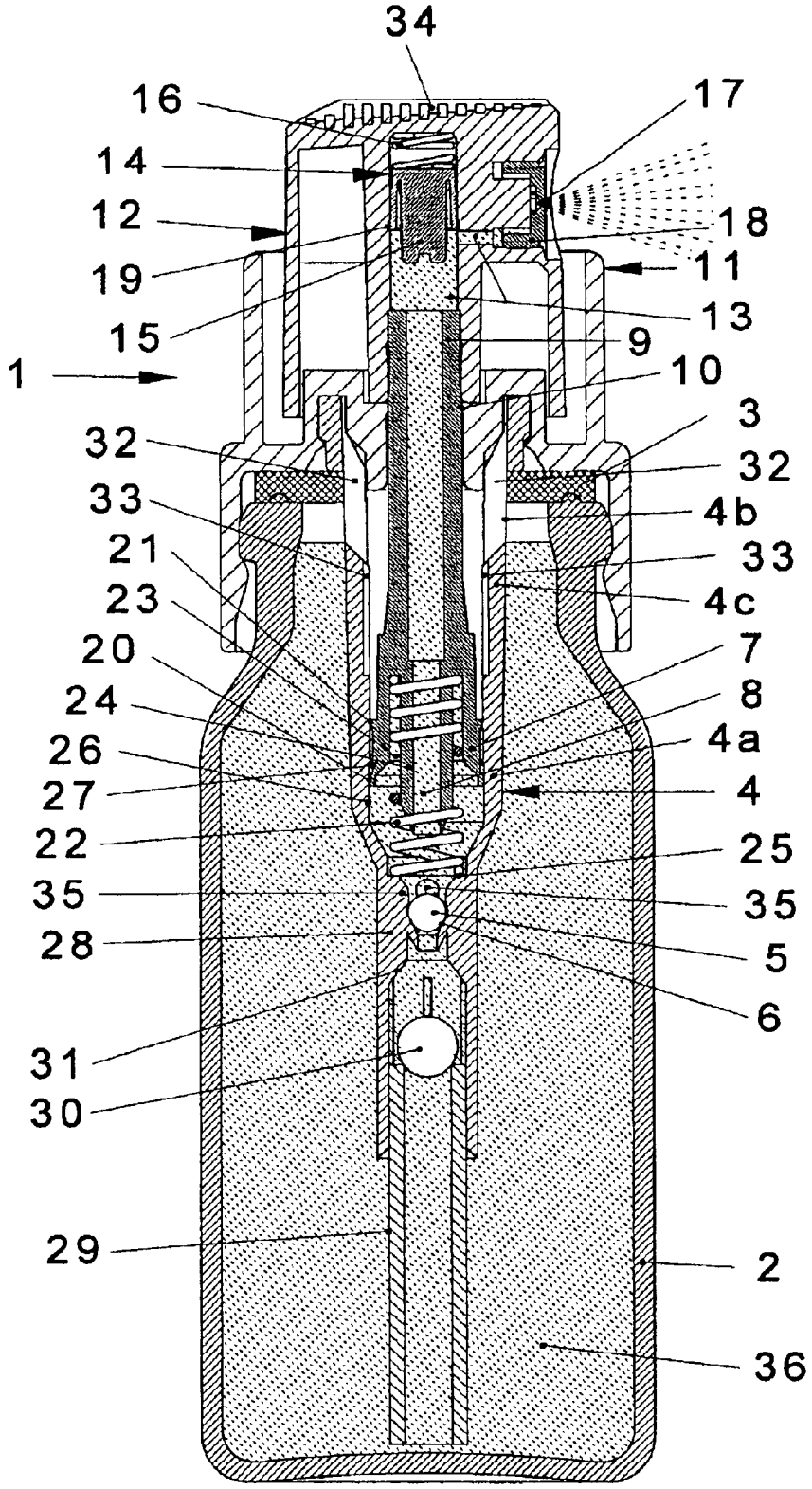
FIG. 3 is the same axial sectional view as FIG. 2, however, shown with the double-acting pump being actuated in the upright normal position of the pump and container.

When the actuating head 12 is actuated for the first time by manually applying a pressure on its upper side provided with a corrugation 34, the piston 7 moves against the force of the restoring spring 22 in the space 26 in the direction toward the connecting pipe piece 28 toward the bottom, as seen in the upright position shown in FIGS. 2 and 3. The air pressure produced as a result in the space 26, in the bore 8 and in the outlet duct 13 keeps the check valve 5, 6 closed, on the one hand, and, on the other hand, presses the sealing lip 19 of the valve closing piece 15 tightly against the inner side of the first portion of the outlet duct 13, so that the valve closing piece 15 is moved upwardly against the force of the restoring spring 16 and releases the passage through the second portion of the outlet duct 13 to the ejection opening 17. The air which is initially still contained in the pressure chamber 26 can then escape through the bore 8 and the outlet duct 13. After the manual pressure is removed, the restoring spring 22 once again presses the piston 7 into the upper end position and the restoring spring 16 presses the valve closing piece 15 into the lower end position shown in FIG. 2. The resulting negative pressure in the pressure chamber 26 causes the first valve closing piece 5 to assume its upper end position against axial ribs 35 in the connecting-pipe piece 28, while the second valve closing piece 30 is lifted from the upper end of the immersion pipe 29, but is not lifted up to the closing position at the valve seat 31, and the product 36, for example, a liquid, is suctioned from the container 2 through the immersion pipe 29 and the connecting pipe piece 28 into the pressure chamber 26 and, possibly after another actuation and release of the actuating head 12, through the bore 8 to the valve closing piece 15. When the actuating head 12 is once again pressed down into the position shown in FIG. 3, the product is dispensed until the sealing lip 20 of the piston 7 has been pressed down under the step 27. At that moment, the pressure in the pressure chamber 26 is relieved past the sealing lip 20 and the collar 21 through the passage 33 and the openings 32 to the inner space of the container 2, so that the ejection of product stops during a pressing stroke. As a result, a precisely metered dispensed amount is achieved each time when the actuating head 12 is actuated.

Such an actuation in the upright position of the double-acting pump and the container 2 is illustrated in FIG. 3.

Figure 4:
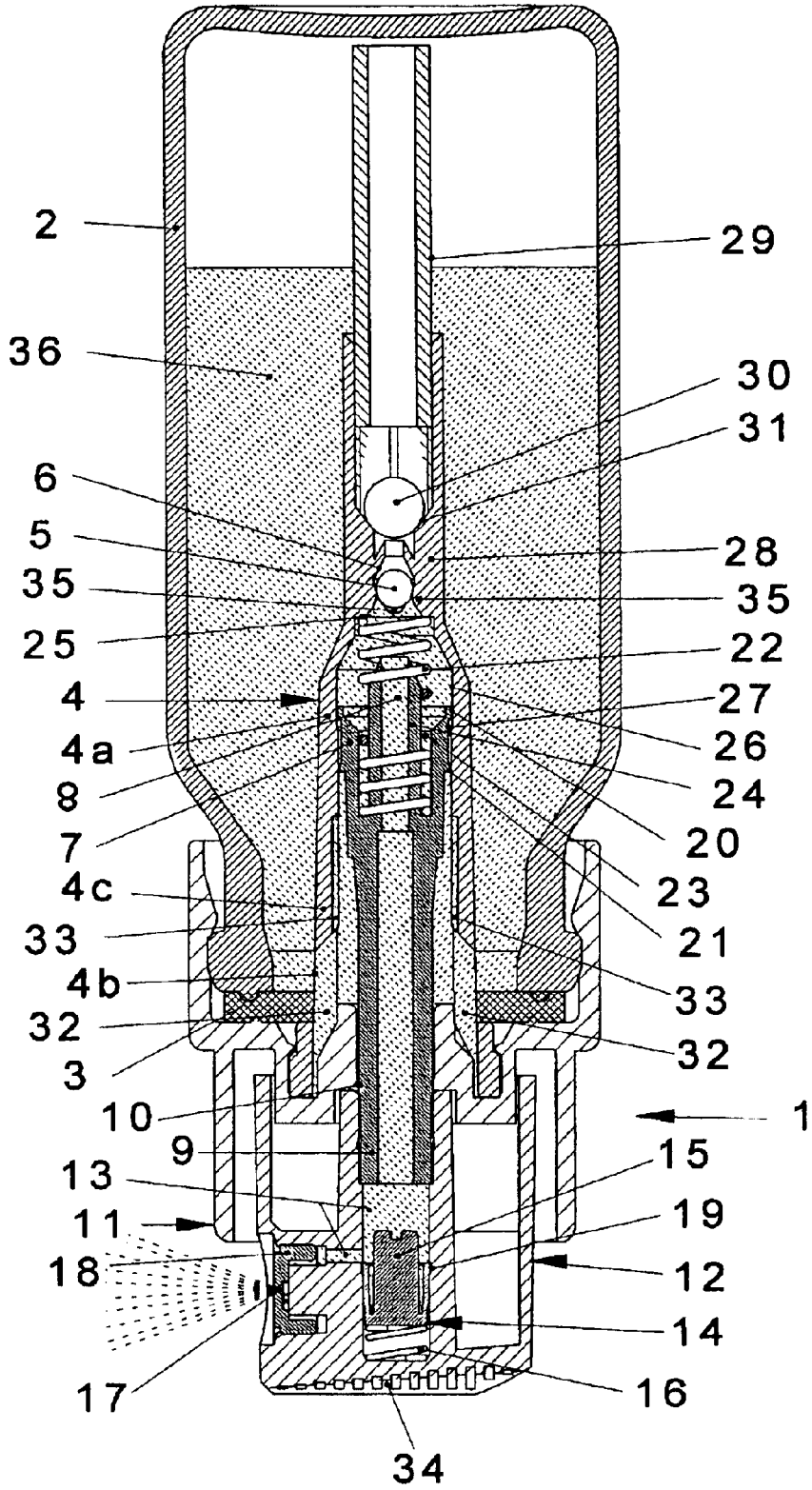
FIG. 4 is the same axial sectional view as FIG. 3, however, shown in an upside down position.

In an inverted position, for example, an upside down position as it is shown in FIG. 4, in which the actuating head 12 is lower than the connecting pipe piece 28, it is not possible to suction the product 36 or air through the immersion pipe 29 out of the container 2. Rather, the product 36 is suctioned only through the openings 32 and the grooves 33, as soon as the sealing lip 20 reaches the area of the grooves 33, because then the second valve closing piece 30 rests against the valve seat 31 as a result of the negative pressure as well as as a result of its own weight, and the valve closing piece 30 blocks the passage through the connecting pipe piece 28 while the first valve closing piece 5 has been removed from its valve seat 6.

On the other hand, when the actuating head 12 is actuated in the position of the double-acting pump 1 shown in FIG. 4 until the sealing lip 20 moves over the step 27, the first valve closing piece 5 is pressed against its seat 6, and the product 36 is ejected from the pressure chamber 26 through the bore 8, the valve 14 which is now open again and the outlet duct 13.

Consequently, the double-acting pump 1 can carry out suction and pressing strokes in any selected position until the container 2 is empty.

In accordance with a modified embodiment of the present invention, the grooves 33 are omitted and the openings 32 are instead extended to the lower end of the grooves 33 as seen in FIG. 1. In the position of the piston 7 shown in FIG. 2, the passage could be effected directly through the openings 32. However, the grooves 33 provide the advantage that the housing portion 4*c* remains stable and is not significantly distorted when its plastic material mass hardens during the manufacture, as this could be the case with the openings 32 which extend into the housing portion 4*c*. Accordingly a tight contact is ensured between the housing 4 and the piston 7 over the entire stroke of the piston.

While specific embodiments of the invention have been shown and described in detail to illustrate the inventive principles, it will be understood that the invention may be embodied otherwise without departing from such principles.

We claim:

1. A double-acting pump for ejecting a product from a container, the pump comprising, a housing, a piston with an axial bore axially slideable in the housing, wherein the piston is sealed by a first housing portion, a hollow piston rod which extends the axial bore of the piston, wherein the hollow piston rod is displaceable in an opening of a closing cap for the housing and container, wherein the hollow piston rod has at a free end thereof a tightly attached actuating head, wherein, when the actuating head is actuated, the piston is pressed against a restoring spring force toward a connecting pipe piece for an immersion pipe provided in the housing and builds up a pressure in a pressure chamber of the housing which presses a first valve closing piece in the connecting pipe piece against a first valve seat, wherein the actuating head contains an outlet duct connected to the bore and extending through a check valve to an ejection opening for the product, wherein at least one opening is provided in a second housing portion between the first housing portion and the closing cap, wherein, in a non-actuated state of the pump, the piston releases as a result of the restoring spring force a passage between the pressure chamber and the at least one opening in the second housing portion, and wherein the connecting pipe piece comprises a second valve seat and a second valve closing piece, wherein, when the double-acting pump is in a position in which the actuating head is lower than the connecting pipe piece, the second valve closing piece assumes its closing position at the second valve seat, and, in an inverted position in which the actuating head is higher than the connecting pipe piece, the second valve closing piece assumes an open position.

2. The double-acting pump according to claim 1, wherein the second valve closing piece is actuatable by its own weight.

* * * * *